United States Patent [19]

Nishida et al.

[11] Patent Number: 5,037,280

[45] Date of Patent: Aug. 6, 1991

[54] SCROLL FLUID MACHINE WITH COUPLING BETWEEN ROTATING SCROLLS

[75] Inventors: Mitsuhiro Nishida; Kozaburo Fujii, both of Fukuoka; Etsuo Morishita, Hyogo; Sakuei Yamamoto, Fukuoka, all of Japan

[73] Assignee: Mitsubishi Denki K.K., Tokyo, Japan

[21] Appl. No.: 577,827

[22] Filed: Sep. 6, 1990

Related U.S. Application Data

[63] Continuation of Ser. No. 425,456, Oct. 23, 1989, abandoned, which is a continuation of Ser. No. 151,851, Feb. 3, 1988, abandoned.

[30] Foreign Application Priority Data

Feb. 4, 1987 [JP] Japan ..... 62-23931
Jun. 26, 1987 [JP] Japan ..... 62-160350

[51] Int. Cl.[5] ..... F01C 1/04; F01C 17/06; F16D 3/04

[52] U.S. Cl. ..... 418/55.3; 464/104; 464/105

[58] Field of Search ..... 418/55 R, 188, 55.3; 464/102, 104, 105

[56] References Cited

U.S. PATENT DOCUMENTS

| | | | |
|---|---|---|---|
| 1,501,647 | 7/1924 | Campbell | 464/105 |
| 4,178,143 | 12/1979 | Thelen et al. | 418/55 R |
| 4,610,610 | 9/1986 | Blain | 418/188 |
| 4,753,582 | 6/1988 | Morishita et al. | 418/188 |

*Primary Examiner*—John J. Vrablik
*Attorney, Agent, or Firm*—Sughrue, Mion, Zinn, Macpeak & Seas

[57] ABSTRACT

A scroll fluid machine comprising a first scroll rotated by a drive source, a second scroll eccentric from the central axis of the first scroll, the second scroll cooperating with the first scroll to compress fluid, a coupling which is provided on the outer end surface of one of said first and second scrolls and engaged with the one scroll at two positions in the periphery thereof so that the scrolls are movable in diametrical directions which are perpendicular to each other, respectively, and a pair of coupling arms which are provided on the other of the first and second scrolls and engaged with the coupling at two positions in the periphery thereof, in such a manner that the phantom line connecting the positions of engagement of said coupling arms is perpendicular to the phantom line connecting the positions of engagement of said coupling.

10 Claims, 13 Drawing Sheets

SCROLL FLUID MACHINE WITH COUPLING BETWEEN ROTATING SCROLLS

This is a continuation of application Ser. No. 425,456, filed Oct. 23, 1989, now abandoned, which is a continuation of application Ser. No. 151,851, filed Feb. 3, 1988, now abandoned.

BACKGROUND OF THE INVENTION

This invention relates to a fully rotary type scroll fluid machine in which a driving scroll and a driven scroll are rotated.

In general, a kind of volume type compressor in which a pair of spiral protrusions are operated for compression, namely, a scroll compressor is extensively employed as a scroll fluid machine of this type.

The operating principle of the scroll compressor is generally as follows: As disclosed by the specifications of U.S. Pat. Nos. 3,884,599 and 2,475,247, one of the spiral protrusion is rocked with the other fixed, to achieve compression.

A so-called "fully-rotary type scroll compressor", in which the spiral protrusions are rotated around their own axes, is also well known in the art over the above-described U.S. Patents.

The operating principle of the fully-rotary type scroll compressor will be described. As shown in FIG. 22, a driving scroll 1 is rotated around its axis $O_1$ by means of a drive source such as an electric motor, engine or turbine, while a driven scroll 2 is also rotated around its axis $O_2$ in synchronization with the rotation of the driving scroll 1. As the scrolls are rotated in this manner, a compression chamber 3 formed between the spiral protrusions 1*a* and 2*a* of the scrolls 1 and 2 decreases its volume while moving towards the center, thus compressing the gas therein. The gas thus compressed is discharged, as high-pressure gas, through a discharge outlet 2*c*. The part (a) of FIG. 22 shows the scrolls turns through 0°; that is, it shows that gas is sucked into the compression chamber 3. While the scrolls are turned 0°—90°—180°—270°—360° (0°) as shown in the parts (a) through (d) of FIG. 22, the compression chamber 3 decreases its volume while moving towards the center. It should be noted that, during this period, sealing parts S formed by the spiral protrusions 1*a* and 2*a* of the scrolls 1 and 2 are maintained aligned in a diametrical direction of the scroll compressor.

In the scroll compressor, the torque of the driving scroll 1 is transmitted to the driven scroll 2 as follows: As described in the specification of the aforementioned U.S. Pat. No. 2,475,247, a coupling (not shown) through which the driving scroll and the driven scroll are coupled to each other is provided on the side of their central axes in such a manner that it is movable in an X-Y direction; or as described in the specification of the aforementioned U.S. Pat. No. 3,884,599, a coupling (not shown) is disposed between the scrolls 1 and 2 in such a manner as to extend over the diameter of the scroll compressor.

As was described above, in the conventional scroll fluid machine, the coupling is arranged between the two scrolls. Therefore, in the case where one of the two scrolls, after being connected to the coupling, is combined with the other, the coupling is covered by the other scroll. As a result, it is considerably difficult to position the scrolls and the coupling thereby to assemble them; that is, the assembling work of the coupling is troublesome.

On the other hand, as the coupling wears, the abrasion powder is liable to be caught directly between the spiral protrusions thereby to accelerate the abrasion of the latter; that is, the sealing ability of the spiral protrusions is lowered in a short period. As a result, in the case of a compressor, the compression efficiency is lowered; and in the case of a vacuum pump, the degree of vacuum is decreased. Furthermore, when the coupling has been worn out, it is necessary to remove the scrolls from the machine. That is, the conventional scroll fluid machine is low in maintenance.

In view of the foregoing, an object of this invention is to provide a scroll fluid machine in which the assembling work of the coupling and the maintenance can be achieved readily, and the sealing ability of the spiral protrusions can be maintained unchanged for a long period.

SUMMARY OF THE INVENTION

The foregoing object of the invention has been achieved by the provision of a scroll fluid machine which, according to the invention, comprises: a first scroll rotated by a drive source; a second scroll eccentric from the central axis of the first scroll, the second scroll cooperating with the first scroll to compress fluid; a coupling which is provided on the outer end surface of one of the first and second scrolls and engaged with the one scroll at two positions in the periphery thereof so that the scrolls are movable in diametrical directions which are perpendicular to each other, respectively; and a pair of coupling arms which are provided on the other of the scrolls and engaged with the coupling at two positions in the periphery thereof in such a manner that the line connecting the positions of engagement of the coupling arms is perpendicular to the line connecting the positions of engagement of the coupling.

In the scroll fluid machine of the invention, the coupling is movable for instance in the X-direction with respect to one of the two scrolls and is movable, with the aid of the coupling arms, in the Y-direction with the Y-direction perpendicular to the X-direction, so that the scrolls can rotate around their own axes shifted from each other.

DETAILED DESCRIPTION OF THE INVENTION

Figure 1:
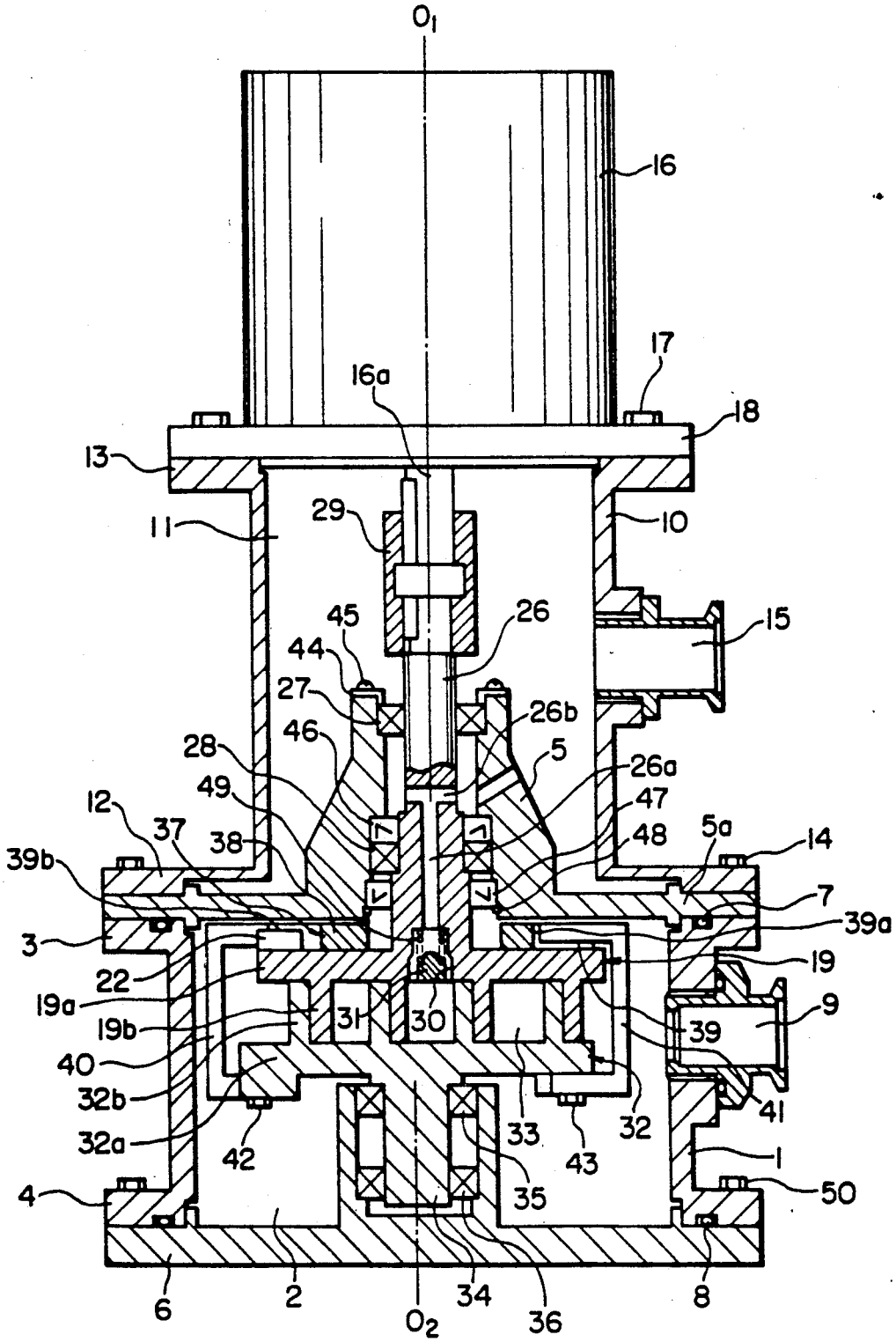
FIG. 1 is a vertical sectional view showing a scroll vacuum pump which is one example of a scroll fluid machine according to this invention.
Figure 4A:
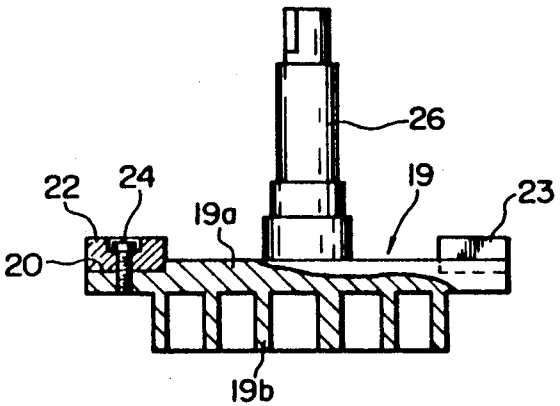
FIGS. 4A and 4B are a side view, with parts cut away, and a plan view showing a driving scroll in the scroll vacuum pump.
Figure 4B:
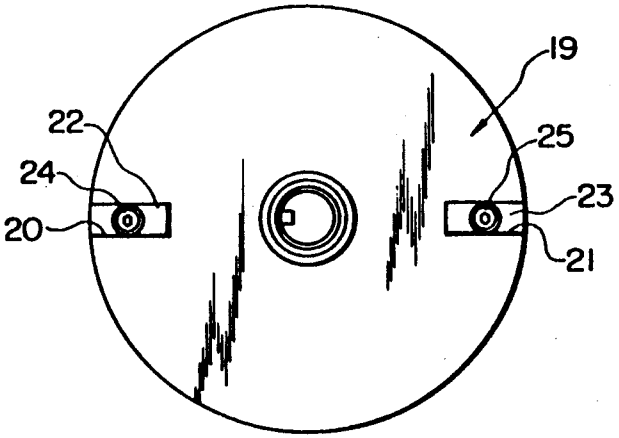
Figure 2A:
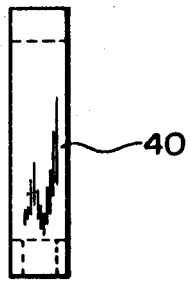
FIGS. 2A and 2B are a side view and a front view, respectively, showing a coupling arm in the scroll vacuum pump.
Figure 2B:
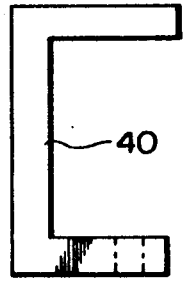
Figure 3:
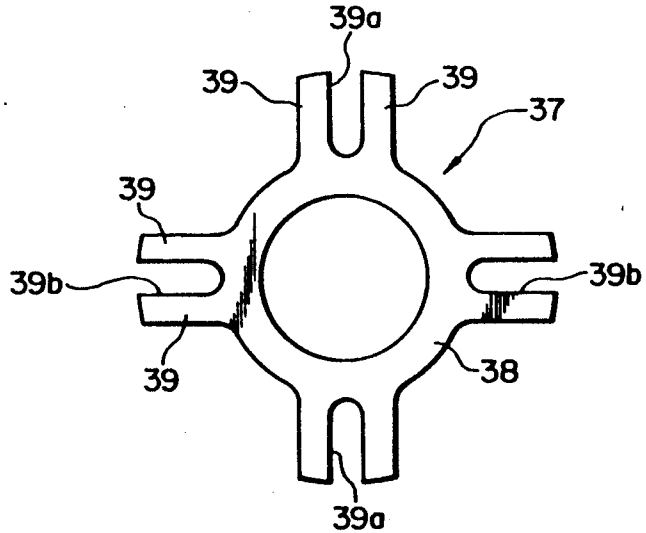
FIG. 3 is a plan view showing a coupling in the scroll vacuum pump.

FIG. 1 is a vertical sectional view of a scroll vacuum pump which is one example of a scroll fluid machine according to this invention. FIGS. 2A and 2B are a side view and a front view showing a coupling arm in the scroll vacuum pump, respectively. FIG. 3 is a plan view showing a coupling in the scroll vacuum pump. FIGS. 4A and 4B are a side view, partly as a sectional view, and a plan view showing a driving scroll in the scroll vacuum pump, respectively.

In these figures, reference numeral 1 designates a cylinder-shaped first container having a suction chamber 2 therein and mounting flanges 3 and 4 on both open ends. An upper bearing housing 5 and a lower bearing housing 6 are secured through O-rings 7 and 8 to the mounting flanges 3 and 4, respectively. A suction pipe 9 is coupled to the container 1, between the flanges 4, in such a manner that it is open sidewardly. Reference numeral 10 designates a cylinder-shaped second container having an atmospheric chamber 11 therein, and mounting flanges 12 and 13 at both open ends. The mounting flanges 12 and 13 are different in diameter from each other. The second container 10 is secured through the flange 5*a* of the upper bearing housing 5 with bolts 14. A discharge pipe 15 is coupled to the wall of the container 10, between the flanges 12 and 13, in such a manner as to open sidewardly. Reference numeral 16 designates an electric motor a part of the output shaft 16*a* of which is extended into the atmospheric chamber 11. Its flange 18 is secured to the flange 12 of the second container 2. Reference numeral 19 designates a first scroll, namely, a driving scroll which has a disk-shaped end plate 19*a* and a spiral protrusion 19*b*. The driving scroll 19 is rotatably provided inside the first container 1. Grooves 20 and 21 are cut in the rear side of the end plate 19*a* in such a manner that they are located at both ends of a diameter of the end plate, respectively. Keys 22 and 23 are fixed in the grooves 20 and 21 with bolts 24 and 25, respectively, in such a manner that they are extended outside the grooves, respectively. The driving scroll 19 has a drive shaft 26 extended from the center of the end plate 19*a*. The drive shaft 26 has a gas discharging path 26*a* extended along the central axis, and a plurality of discharge holes 26*b* extended across the gas discharge path 26*a*. The drive shaft 26 is rotatably supported in the upper bearing housing with the aid of bearings 27 and 28 and is coupled through a shaft coupling 29 to the output shaft 16*a* of the motor 16. A discharge chamber 30 communicating with the gas discharging path 26*a* is formed in the drive shaft 26*a* and the driving scroll 19.

Reference numeral 31 designates a check valve for compressed fluid which is provided in the discharge chamber 30. Reference numeral 32 designates a second scroll, namely, a driven scroll which has a disk-shaped end plate 32*a* and a spiral protrusion 32*b*. The second scroll is rotatably provided inside the first container 1. More specifically, the second scroll 32 is located below the driving scroll 19 so that it cooperates with the first scroll 19 to compress the fluid in a compression chamber 33. Reference numeral 34 designates a boss having the central axis $O_2$ which is eccentric from the central axis $O_1$ of the driving scroll 19; i.e., the drive shaft 26. The boss 34 is extended from the center of the end plate 32*a* of the driven scroll 32, and is rotatably supported in the lower bearing housing 6 with the aid of bearings 35 and 36. Reference numeral 37 designates a torque transmitting coupling which comprises an annular base 38 and four ribs 39 extended from the annular base 38 at angular intervals of 90°. The coupling 37 is disposed on the outer surface of the driving scroll 19 as viewed in the axial direction; i.e., on the rear surface of the end plate 19*a*. The coupling 37 is engaged with the driving scroll 19 through the aforementioned keys 22 and 23. One end portion of coupling arms (described later) and the keys 22 and 23 are engaged with the guide grooves 39*a* and 39*b* thus formed.

Reference numerals 40 and 41 designate the coupling arms which have one end portion secured to the end plate 32*a* of the driven scroll 32 with bolts 42 and 43 and the other end portions engaged with the periphery of the above-described coupling 37. The positions of engagement of the coupling arms 40 and 41 and the positions of engagement of the coupling 37 are so determined that the line connecting the former positions of engagement forms right angles with the line connecting the latter positions of engagement.

Further in FIGS. 1 through 4, reference numeral 44 designates a locking plate adapted to lock the upper bearing 27 in the upper bearing housing 5; 45, screws adapted to secure the locking plate 44 to the upper bearing housing 5; 46 and 47, sealing members mounted on the drive shaft to sealingly close the atmospheric chamber 11 and the suction chamber 2, respectively; 48, a retaining ring which supports the sealing member 47 in the upper bearing housing 5; 49, a spring adapted to cause the check valve in the discharge outlet 30 to close; and 50, bolts fixedly securing the first container 1 to the lower bearing housing 6. A vacuum-operated container (not shown) is connected to the outer open end of the suction pipe 9.

The operation of the scroll vacuum pump thus constructed will be described.

As the driving scroll 19 is rotated around its central axis $O_1$ by the motor 16, the driven scroll 32 is synchronously rotated around the central axis $O_2$. In this operation, the coupling 37 on the driving scroll 19 and the coupling arms 40 and 41 cause the scrolls 19 and 32 to rotate at the positions which are staggered exactly 180°. In addition, the protrusions **19*b* and 32*b* are partly brought into contact with each other to completely seal the compression chamber 33 so that the degree of vacuum therein is increased. As the scrolls 19 and 32 are rotated, the fluid in the vacuum-operated container (not shown) is sucked into the suction chamber 2. It is compressed in the compression chamber 33 to open the check valve 31, as a result of which it is discharged out of the pump through the gas discharging path 26*a*, the discharge holes 26*b*, the atmospheric chamber 11, and the discharge pipe 15**.

Now, transmission of the torque of the driving scroll 19 to the driven scroll 32 will be described in detail. The keys 22 and 23 on the end plate **19*a* of the driving scroll 19 are engaged with the guide grooves 39*b* of the coupling 37, as was described above. Therefore, the torque of the driving scroll 19 is transmitted through the keys 22 and 23 to the coupling 37. On the other hand, the one end portions of the coupling arms 40 and 41 are engaged with the guide grooves 39*a* of the coupling 37 in such a manner that the line connecting the one end portions of the coupling arms forms right angles with that connecting the keys 22 and 23. Therefore, the coupling arms 40 and 41 are turned together with the coupling 37 so that the driven scroll 32 is turned. As was described above, the guide grooves 39*a* and 39*b* are formed in the coupling 37 in such a manner that they are extended in the X-direction and in the Y-direction, respectively, which are perpendicular to each other; and the keys 22 and 23 slidable for instance in the X-direction are engaged with the guide grooves 39*b* while the one end portions of the coupling arms 40 and 41 slidable in the Y-direction are engaged with the guide grooves 39*a*. Therefore, as the driving scroll 19 is turned around the axis $O_1$, the coupling 37 becomes movable for instance in the X-direction with respect to the driving scroll 19 while coupling 37 becomes movable in the Y-direction through the coupling arms 40 and 41 with respect to the driven scroll 32, so that the driven scroll 32** is turned around the axis $O_2$.

Figure 6:
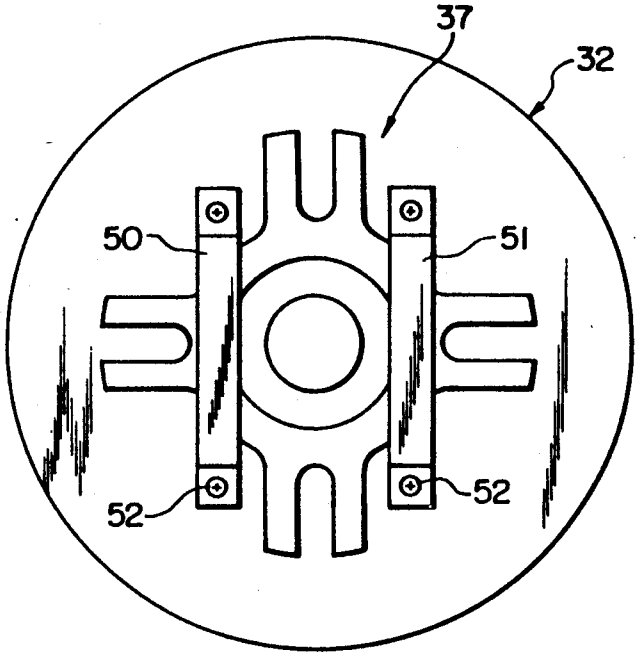
FIGS. 5 and 6 are a front view and a bottom view, respectively, showing the coupling arranged on the side of a driven scroll.
Figure 7:
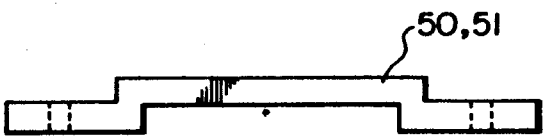
FIG. 7 is a front view showing supporting plates in FIGS. 5 and 6.
Figure 5:
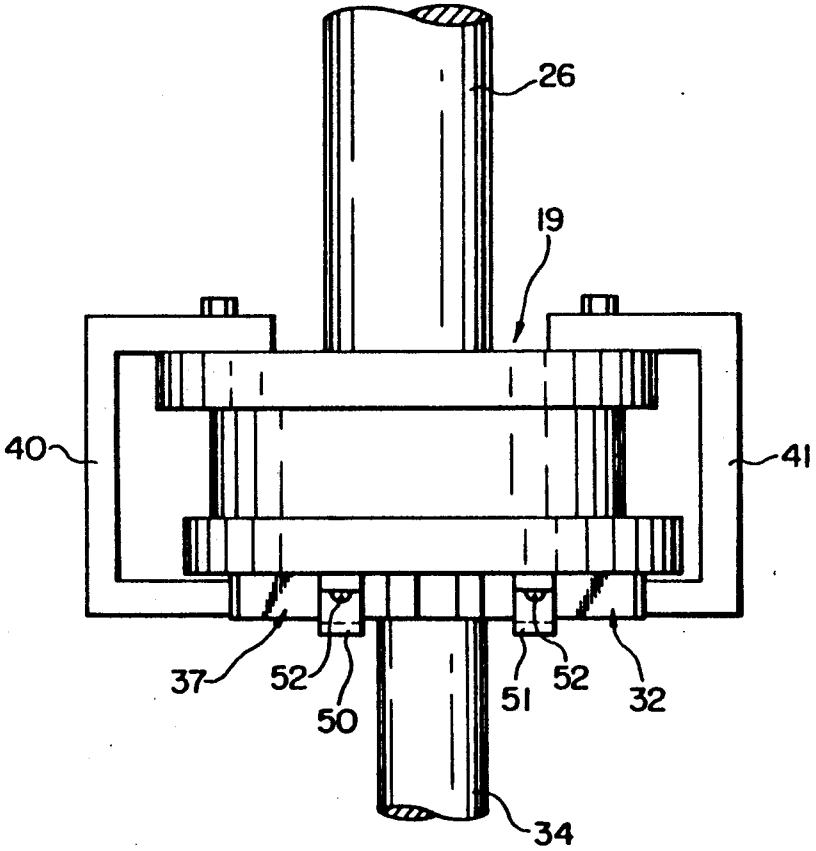

In the above-described embodiment, the coupling 37 is arranged on the side of the driving scroll 19; however, it should be noted that the invention is not limited thereto or thereby; that is, for instance the coupling may be arranged on the side of the driven scroll 32 as shown in FIGS. 5 and 6. In this case, as shown in FIG. 7, two supporting plates 50 and 51 are secured to the driven scroll 32 with screws 52 to support the coupling 37. In this modification, the sliding part of the coupling 37 can be cooled with the lubricant in the first container 1.

Figure 10A:
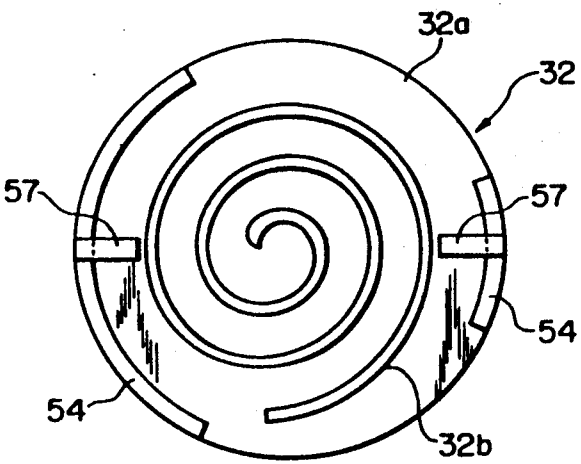
FIGS. 10A and 10B are a plan view and a sectional view, respectively, showing another example of the coupling arms combined with the driven scroll.
Figure 10B:
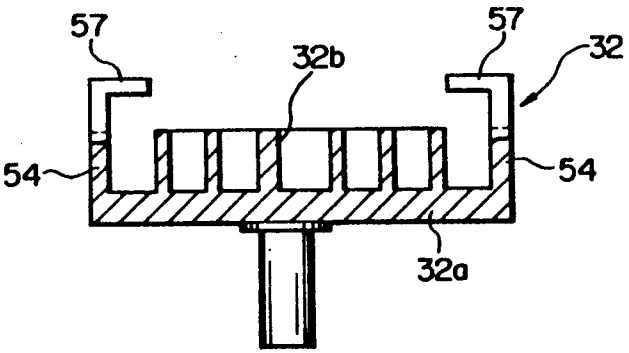
Figure 8A:
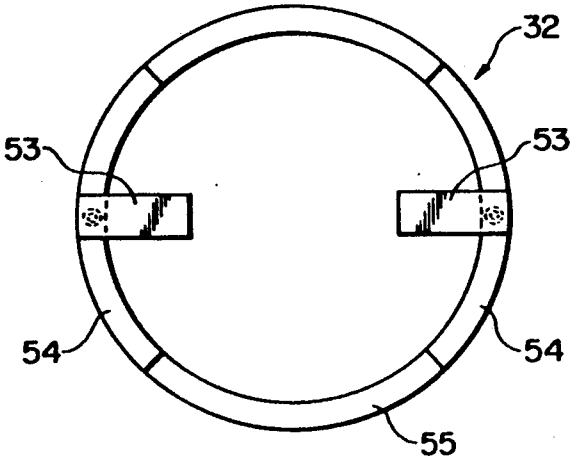
FIGS. 8A and 8B are a plan view and a sectional view, respectively, showing another example of the coupling arms connected to the driven scroll.
Figure 8B:
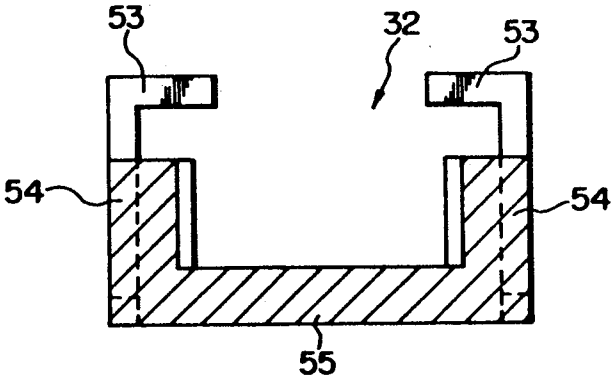
Figure 9:
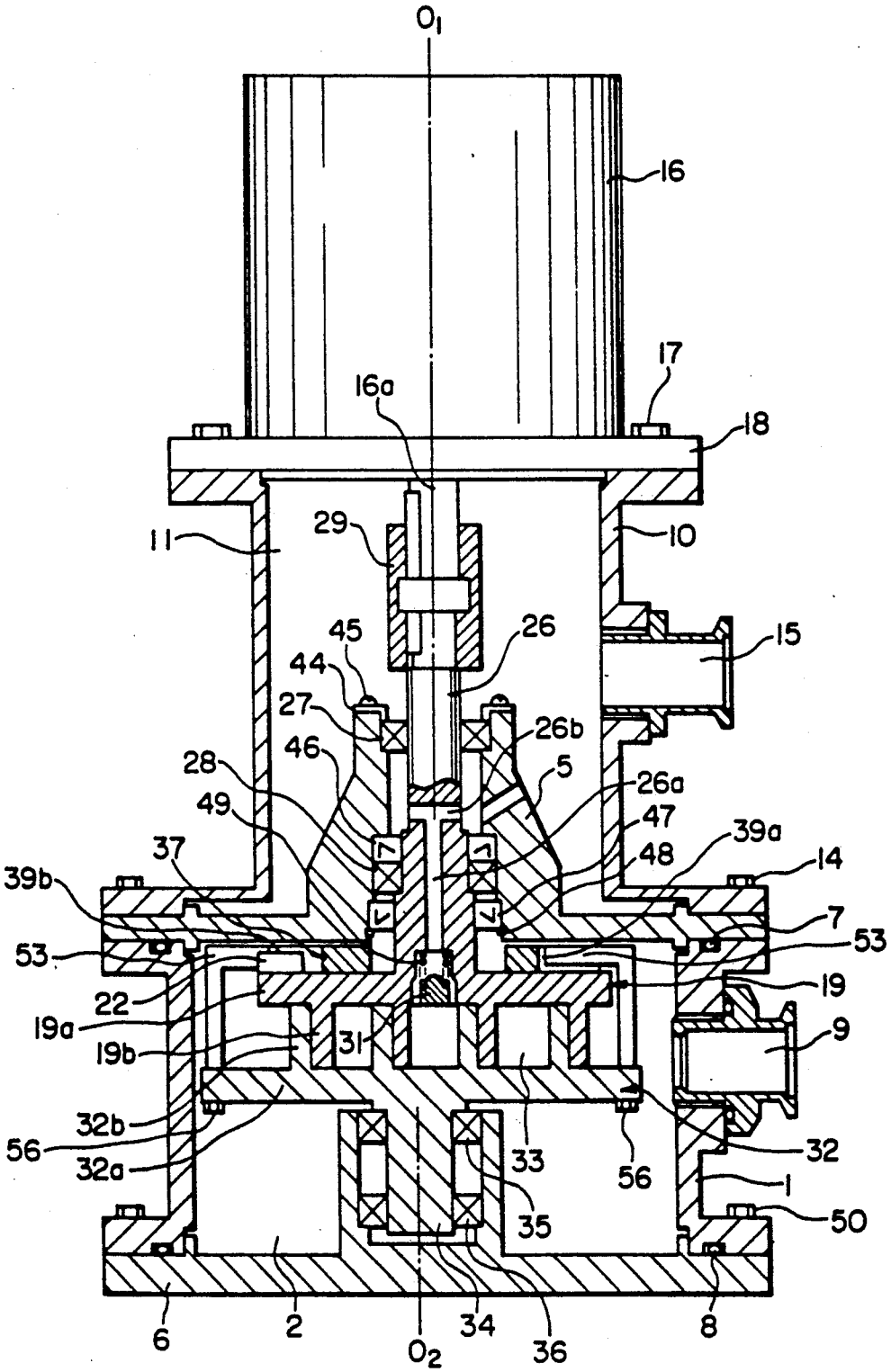
FIG. 9 is a vertical sectional view of a scroll fluid machine having the coupling arms shown in FIG. 8.
Figure 11:
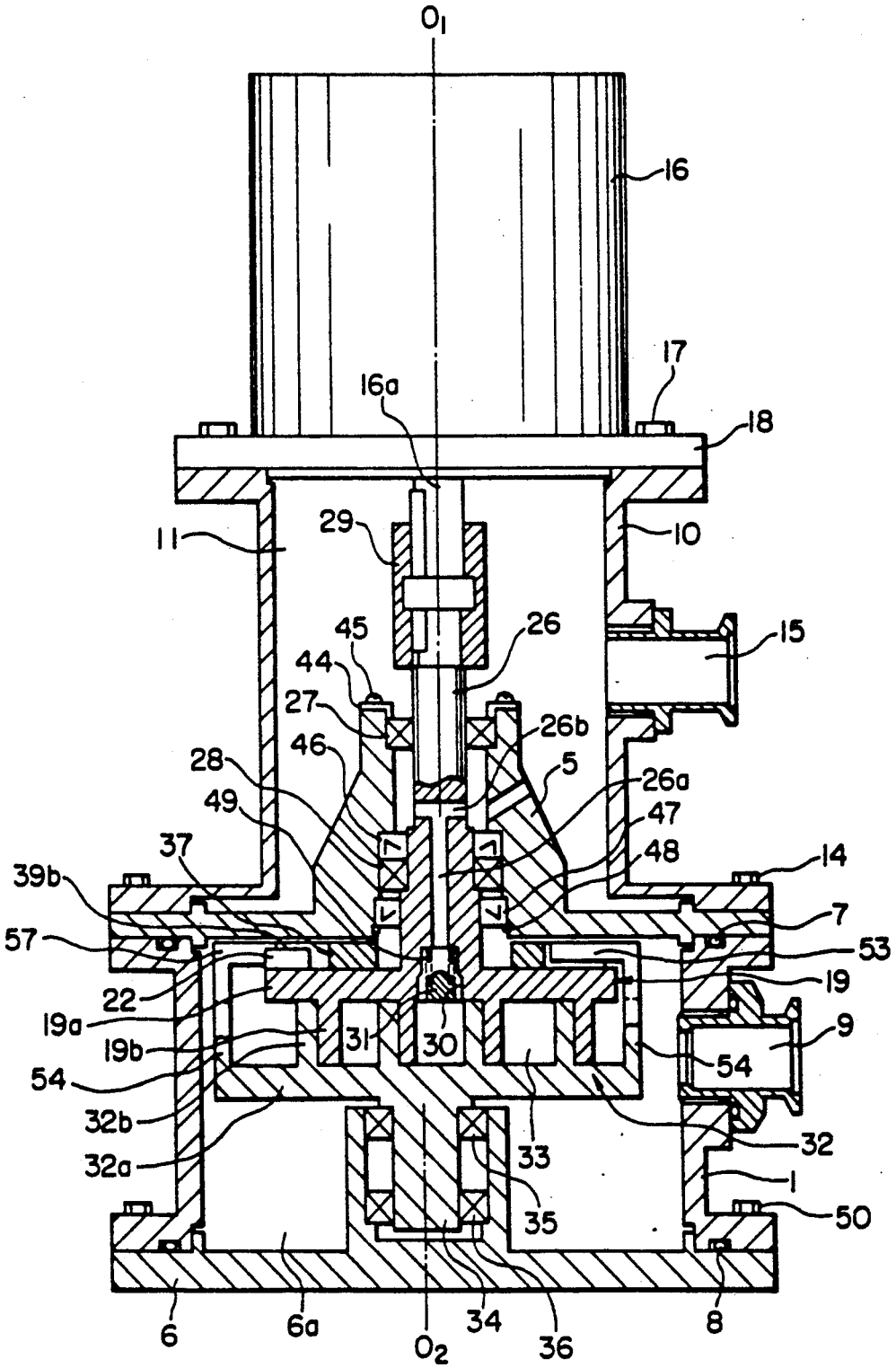
FIG. 11 is a vertical sectional view of a scroll fluid machine having the coupling arms shown in FIG. 9.

In the above-described embodiment, the coupling arms 40 and 41 are substantially U-shaped in section; however, coupling arms 53 substantially L-shaped in section may be employed as shown in FIGS. 8A and 8B and FIG. 9. As shown in these figures, a projection 55 having reinforcing walls 54 is provided along the periphery of the driven scroll 32, and the coupling arms 53 are secured to the reinforcing walls 54 of the projection 55 with bolts 56. In this connection, as shown in FIGS. 10A and 10B and FIG. 11, coupling arms 57 may be integral with the driven scroll 32. Furthermore, if the two reinforcing walls 54 confronted with each other are made different in dimension, then they may be used as balance weights of the driven scroll 32.

Figure 13A:
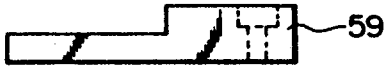
FIGS. 13A and 13B are a front view and a plan view, respectively, showing a key engaged with the coupling of FIG. 12.
Figure 13B:
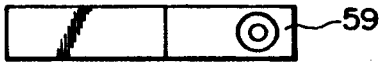
Figure 14A:
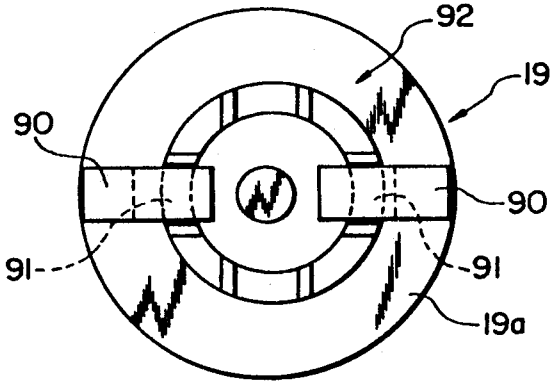
FIGS. 14A and 14B are a plan view and a front view, respectively, showing another example of the coupling connected to the driving scroll.
Figure 14B:
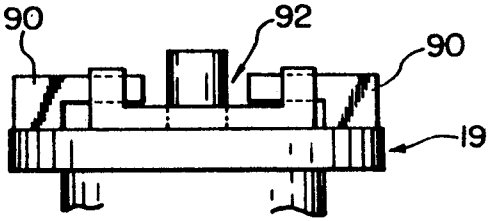
Figure 12A:
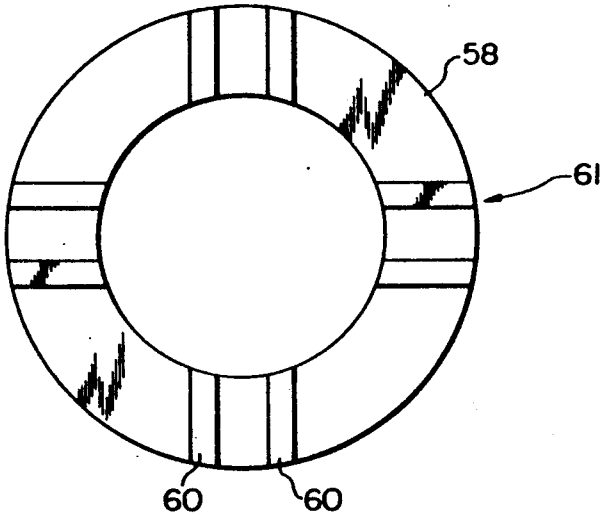
FIGS. 12A and 12B are a plan view and a sectional view, respectively, showing another example of the coupling.
Figure 12B:
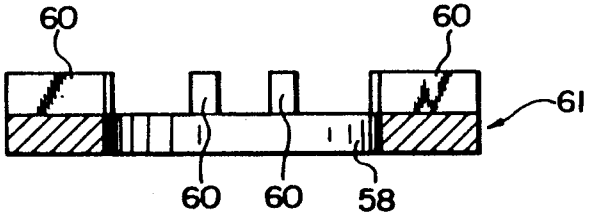

In the above-described embodiment, the coupling 37 comprises the base 38, and the ribs 39 extended from the base 38. However, the same effect can be obtained by using a coupling 61 as shown in FIGS. 12A and 12B. The coupling 61 comprises ribs 60 with which keys 59 (FIG. 13) on the driving scroll 19 are engaged. In this case, only a coupling force acts on the coupling 61 in operation, and therefore not only the operation is smooth, but also noise by vibration can be eliminated. The above-described coupling 61 has the ribs; however, as shown in FIGS. 14A and 14B, guide grooves 91 with which keys 90 are engaged may be formed in the non-slide surface of a coupling 92.

Figure 16:
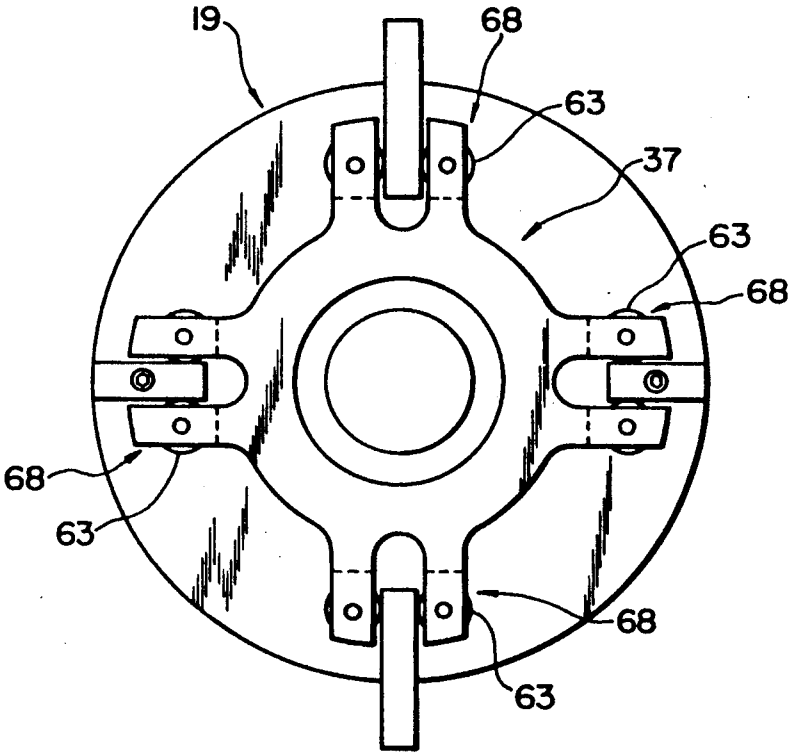
FIGS. 15 and 16 are a plan view showing other examples of the coupling.
Figure 15:
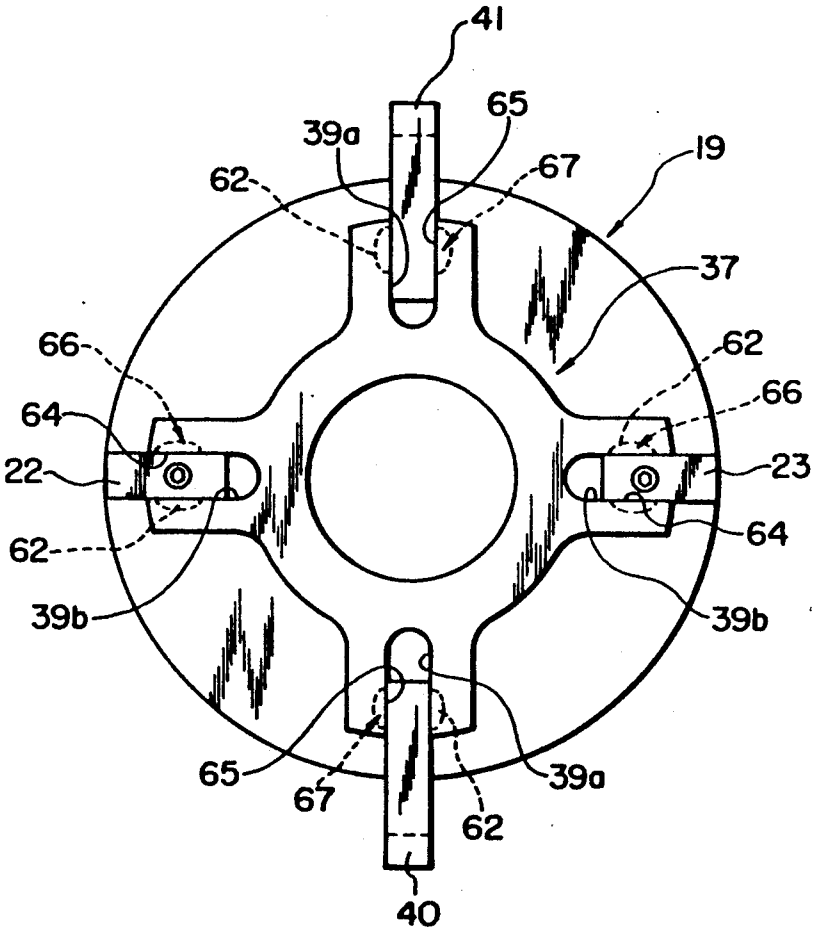

Furthermore, in the above-described embodiment, the keys 22 and 23 and the coupling arms 40 and 41 are merely slid in the guide grooves **39*b* and 39*a* of the coupling 37. However, they may be more smoothly slid therein by applying lubricant 62 as shown in FIG. 15 or by providing rotary members 63 as shown in FIG. 16. In the former case (FIG. 15), spaces 66 and 67 for receiving the lubricant 62 are formed in the slide surfaces 64 between the keys 22 and 23 and the guides grooves 39*b*, and in the slide surfaces 65 between the coupling arms 40 and 41 and the guide grooves 39*a*. In the latter case (FIG. 16), bearings 68 are provided in the ribs 39 of the coupling 37**.

Figure 17:
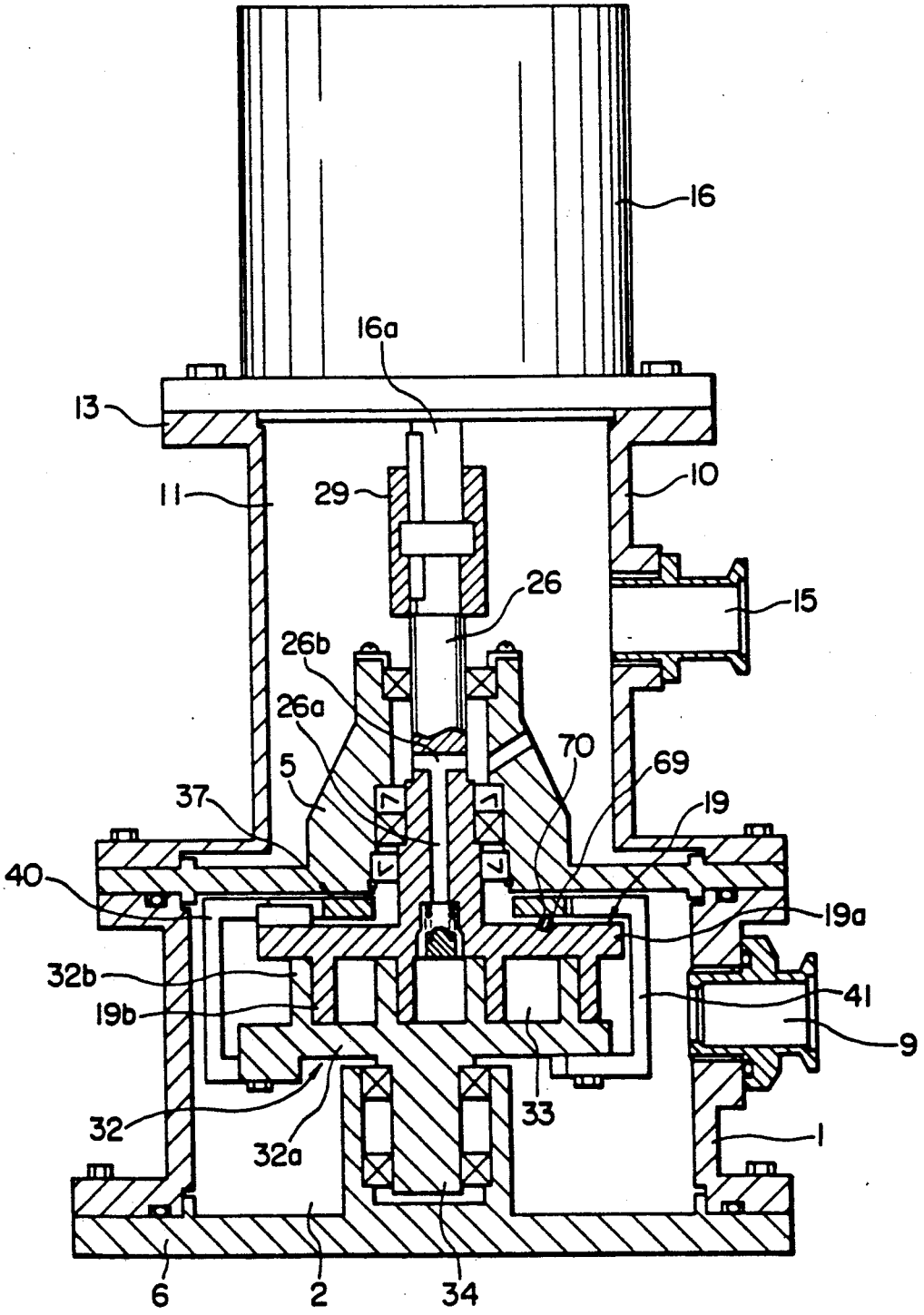
FIG. 17 is a vertical sectional view showing another example of the scroll vacuum pump.
Figure 19:
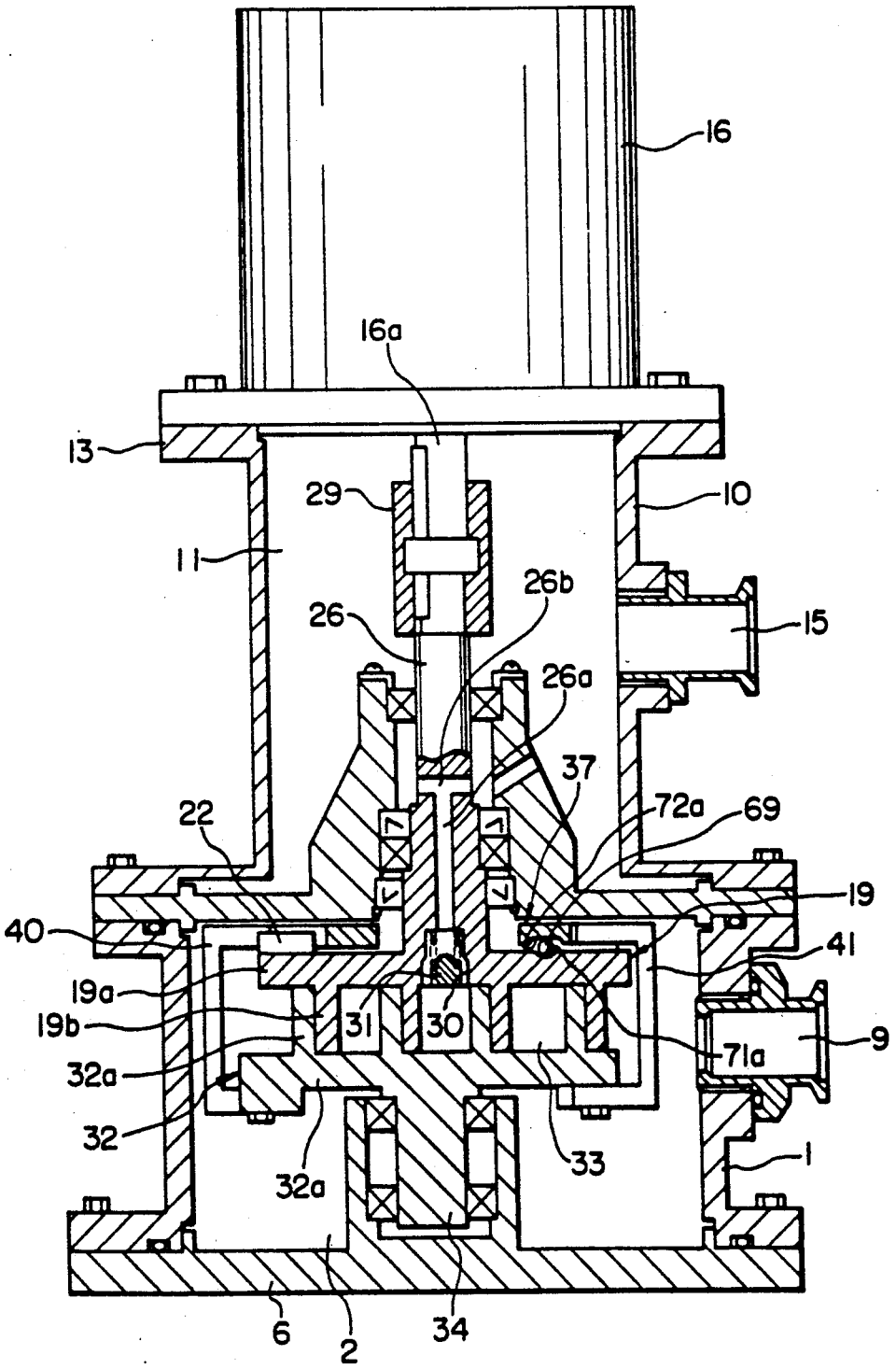
FIG. 19 is a vertical sectional view showing another example of the scroll vacuum pump.
Figure 20:
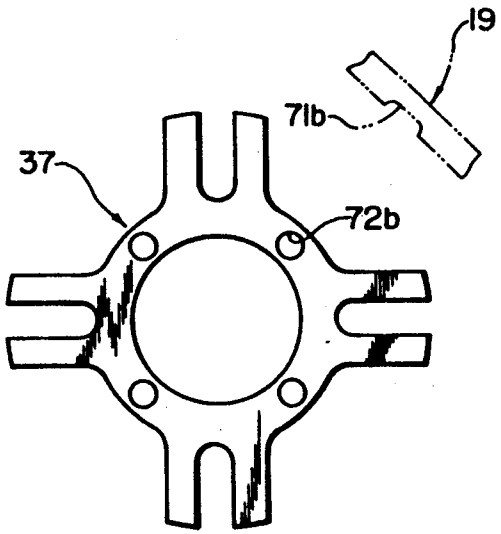
FIG. 20 is a plan view showing a coupling in the scroll vacuum pump of FIG. 19.
Figure 18A:
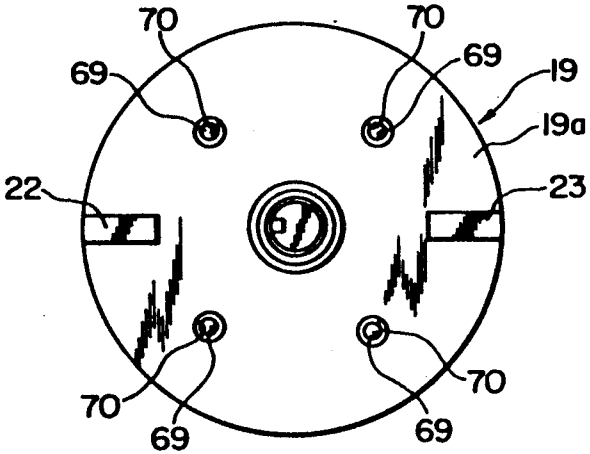
FIGS. 18A and 18B are a plan view and a sectional view, respectively, showing a driving scroll in the scroll vacuum pump of FIG. 17.
Figure 18B:
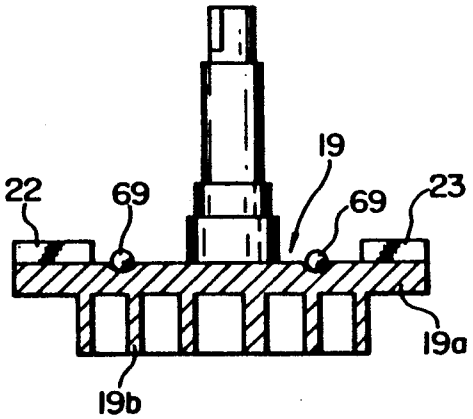
Figure 22A:
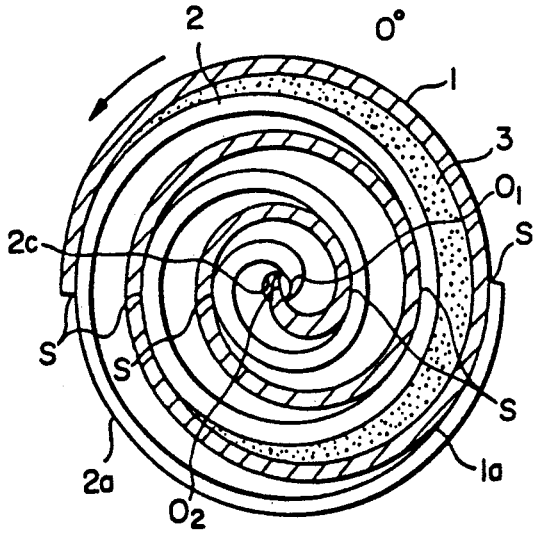
FIGS. 22A through 22D are diagrams for a description of the principle of a scroll fluid machine.
Figure 22B:
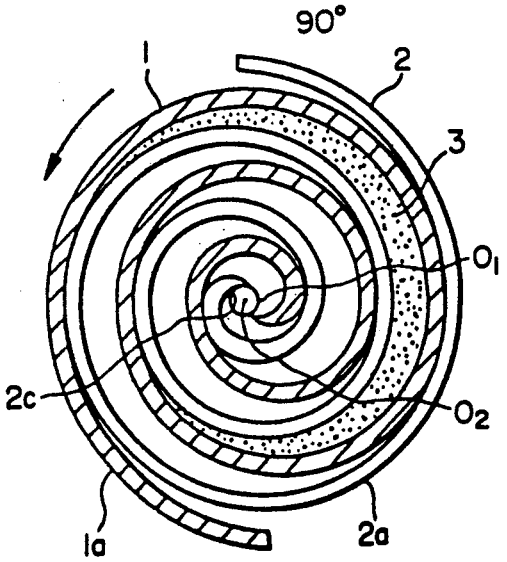
Figure 22D:
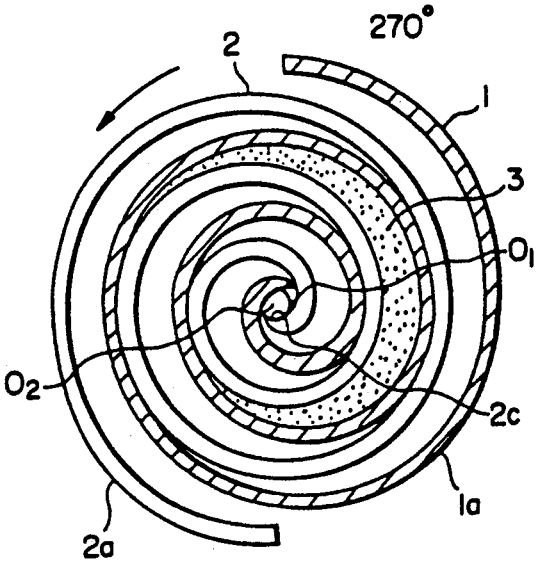
Figure 22C:
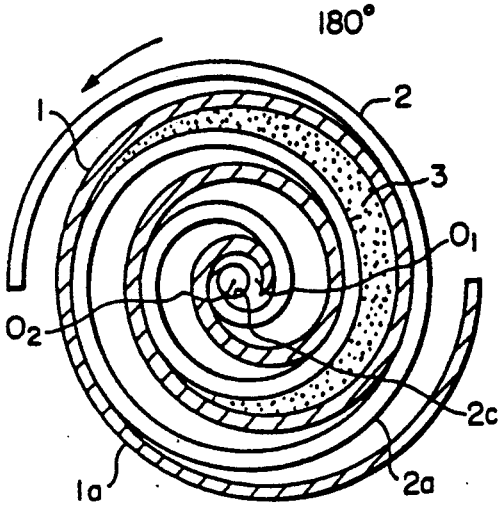
Figure 21:
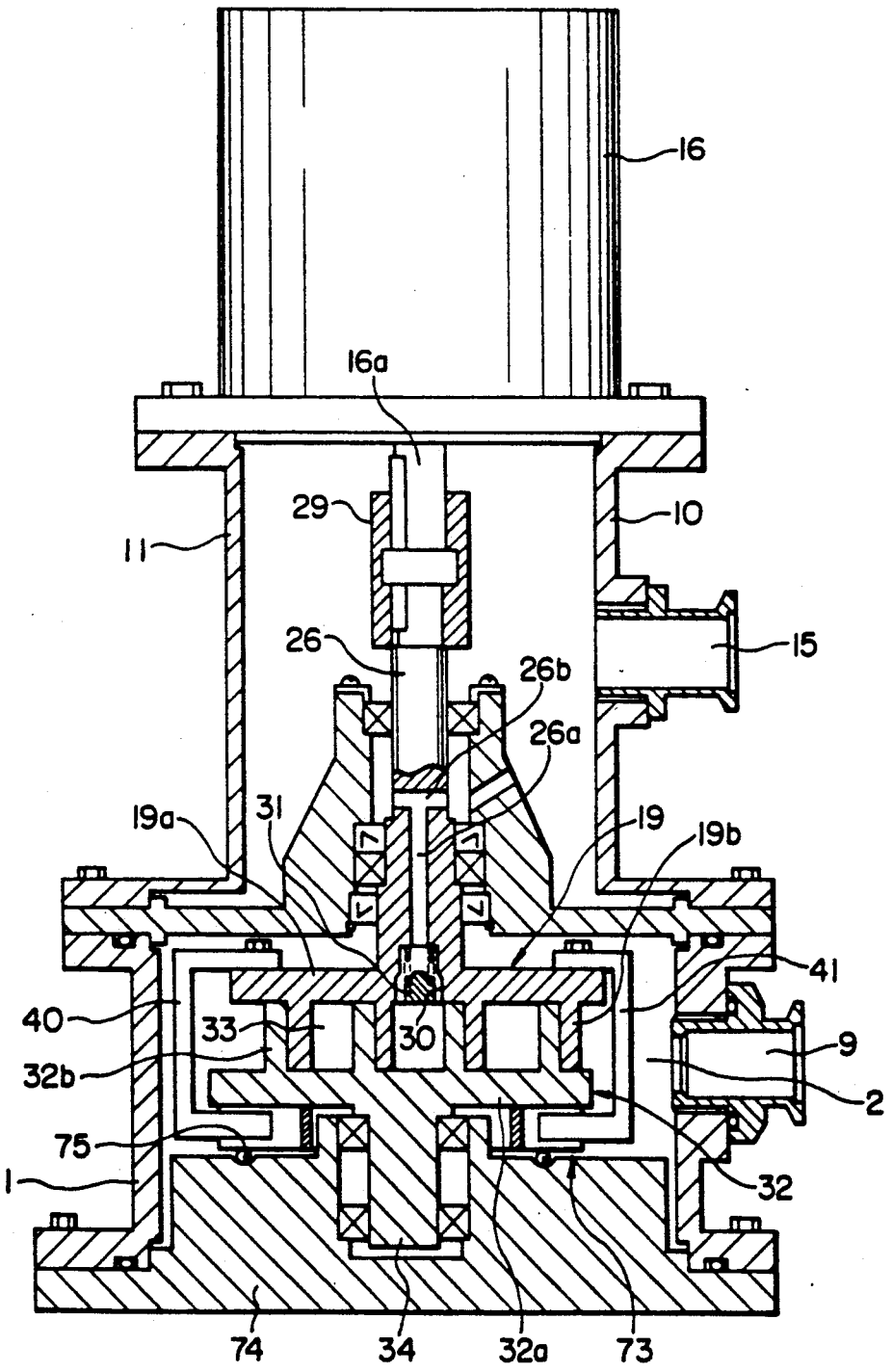
FIG. 21 is a vertical sectional view of another example of the scroll vacuum pump in which the coupling is arranged on the side of the driven scroll.

In the above-described embodiment, the coupling 37 is simply laid on the end plate **19*a* of the driving scroll 19. However, if steel balls 69 are rotatably interposed between the end plate 19*a* and the coupling 37 as shown in FIG. 17 and FIGS. 18A and 18B, wear of the end plate and the coupling can be reduced. In this case, for convenience in the assembling work, recesses 70 are formed in the rear surface of the end plate 19*a*. However, recesses (not shown) may be formed on the coupling 37, or as shown in FIGS. 19 and 20 recesses 71*a* and 71*b* and recesses 72*a* and 72*b* may be formed in the driving scroll 19 and the coupling 37, respectively. Furthermore, in the case where the coupling 73 is arranged on the side of the driven scroll 32, steel balls 75 may be rotatably interposed between the lower bearing housing 1 and the coupling 73**.

In the scroll fluid machine of the invention, the keys 22 and 23 and the coupling arms 40 and 41 are secured to the driving scroll 19 and the driven scroll 32 with the bolts, respectively, as was described above. Therefore, the coupling 37, keys 22 and 23 and coupling arms 40 and 41, which are liable to wear, can be readily replaced; that is, the maintenance of the scroll fluid machine is simple.

While the invention has been described with reference to the scroll vacuum pump, it goes without saying that the technical concept of the invention is applicable to a scroll compressor.

As was described above, the scroll fluid machine of the invention comprises: the first scroll rotated by the drive source; the second scroll eccentric from the central axis of the first scroll; the coupling provided on the outer end face of one of the two scrolls and engaged with the scroll at two positions in the periphery thereof so that the scrolls are movable in the diametrical directions perpendicular to each other; and the coupling arms provided on the other scroll and engaged with the coupling at two positions in the periphery thereof in such a manner that the line connecting the positions of engagement of the coupling is perpendicular to the line connecting the position of engagement of the coupling arms. Therefore, the person can combine the coupling with the scrolls while observing them; that is, the assembling work of these components can be achieved readily. Furthermore, the coupling can be connected to or removed from the scrolls which have been combined together, and therefore the maintenance of the scroll fluid machine can be achieved with ease. Moreover, even when the coupling is worn, the difficulty that the abrasion powder is caught directly by the scrolls is prevented. Accordingly, the sealing ability of the spiral protrusions of the scrolls is maintained unchanged for along period.

What is claimed is:

1. A scroll fluid machine, characterized by comprising:

a first scroll rotated about a first central axis by a drive source, wherein said first scroll comprises a disk-shaped end plate;

a second scroll eccentric from said first central axis of said first scroll, said second scroll cooperating with said first scroll to form compression means to compress fluid, wherein said second scroll comprises a disk-shaped end plate;

a planar shaped coupling which is provided on an outer rear surface of said disk-shaped end plate of one of said first and second scrolls on the opposite side of the compression means and engaged with said one scroll through by means at two positions in the periphery thereof so that said scrolls are movable in diametrical directions which are perpendicular to each other, respectively; and a pair of coupling arms which are provided on the other of said first and second scrolls and engaged with said coupling at two positions in the periphery thereof, in such a manner that the phantom line connecting the positions of engagement of said coupling arms is perpendicular to the phantom line connecting the positions of engagement of said coupling.

2. A scroll fluid machine as claimed in claim (1), in which said coupling is provided on an outer surface of said disk-shaped end plate of said first scroll.

3. A scroll fluid machine as claimed in claim (1), in which said coupling is provided on the side of said second scroll.

4. A scroll fluid machine as claimed in claim (1), (2) or (3), in which said coupling comprises: an annular base; and ribs having guide grooves which are radially outwardly extended from said annular base.

5. A scroll fluid machine as claimed in claim (1), (2) or (3), in which said coupling comprises: an annular member in the surface of which opposite to the adjacent end plate, guide grooves are formed in such a manner that said guide grooves are radially extended.

6. A scroll fluid machine as claimed in claim (5), in which each of said guide grooves is formed by ribs.

7. A scroll fluid machine as claimed in claim (1), in which each of said coupling arms is substantially L-shaped in section.

8. A scroll fluid machine as claimed in claim (1) or (7), in which said coupling arms are integral with the one of said first and second scrolls.

9. A scroll fluid machine as claimed in claim (1) or (8) in which said coupling arms are separated from the one of said first and second scrolls.

10. A scroll fluid machine, characterized by comprising:

a first scroll rotated about a first central axis by a drive source, wherein said first scroll comprises a disk-shaped end plate;

a second scroll eccentric from said first central axis of said first scroll, said second scroll cooperating with said first scroll to compress fluid, wherein said second scroll comprises a disk-shaped end plate;

a coupling which is provided on an outer surface of said disk-shaped end plate of one of said first and second scrolls and engaged with said one scroll at two positions in the periphery thereof so that said scrolls are movable in diametrical directions which are perpendicular to each other, respectively; and a pair of U-shaped coupling arms which are provided on the other of said first and second scrolls and engaged with said coupling at two positions in the periphery thereof, in such a manner that the phantom line connecting the positions of engagement of said coupling arms is perpendicular to the phantom line connecting the positions of engagement of said coupling, wherein each of said coupling arms is substantially U-shaped in section.

* * * * *